US007210199B2

(12) United States Patent
Clark

(10) Patent No.: US 7,210,199 B2
(45) Date of Patent: May 1, 2007

(54) HINGE APPARATUS

(76) Inventor: Richard T. Clark, 930-H Bishops Gate La., Kirkwood, MO (US) 63122

( * ) Notice: Subject to any disclaimer, the term of this patent is extended or adjusted under 35 U.S.C. 154(b) by 62 days.

(21) Appl. No.: 11/020,020

(22) Filed: Dec. 21, 2004

(65) Prior Publication Data

US 2006/0130276 A1 Jun. 22, 2006

(51) Int. Cl.
*E05F 1/08* (2006.01)
*E05D 11/10* (2006.01)

(52) U.S. Cl. ..... 16/299; 16/319; 16/324

(58) Field of Classification Search ..... 16/299, 16/300, 301, 298, 50, 76, 54, 72, 197, 198, 16/273, DIG. 10, DIG. 17, 319, 324, 326
See application file for complete search history.

(56) References Cited

U.S. PATENT DOCUMENTS

| | | | | |
|---|---|---|---|---|
| 6,112 A | * | 2/1849 | Joyce | 16/300 |
| 29,212 A | | 7/1860 | Acker | |
| 36,976 A | | 11/1862 | Acker | |
| 142,855 A | | 9/1873 | Joyce | |
| 252,770 A | | 1/1882 | Howson | |
| 255,938 A | * | 4/1882 | Clark | 16/300 |
| 291,169 A | * | 1/1884 | Duncan | 16/300 |
| 381,100 A | | 4/1888 | Beath | |
| 631,797 A | | 8/1899 | Krause | |
| 822,911 A | * | 6/1906 | Bommer | 16/256 |
| 864,747 A | * | 8/1907 | Wilson | 16/285 |
| 864,932 A | * | 9/1907 | Staples | 16/301 |
| 1,080,456 A | * | 12/1913 | Katzenberger | 16/300 |
| 2,520,616 A | | 8/1950 | Wasson et al. | |
| 3,316,582 A | | 5/1967 | Johnston et al. | |
| 3,339,225 A | | 9/1967 | Booth | |
| 3,426,387 A | | 2/1969 | Bitney | |
| 3,825,973 A | | 7/1974 | Gwozdz | |
| 3,898,708 A | | 8/1975 | Gwozdz | |
| 3,903,567 A | | 9/1975 | Suska | |
| 3,965,533 A | | 6/1976 | Frohlich | |
| 3,978,551 A | | 9/1976 | Mochizuki | |
| 4,043,001 A | | 8/1977 | Parsons | |
| 4,073,038 A | | 2/1978 | Curry et al. | |

(Continued)

FOREIGN PATENT DOCUMENTS

| | | |
|---|---|---|
| AU | 29217 | 9/1931 |

(Continued)

*Primary Examiner*—Robert J. Sandy
*Assistant Examiner*—Andre' L. Jackson
(74) *Attorney, Agent, or Firm*—Hamilton, Brook, Smith & Reynolds, PC

(57) ABSTRACT

A hinge including a first hinge member and a second hinge member that is rotatably coupled to the first hinge member. The hinge has a torsion spring with a first end of the spring secured relative to the first hinge member and a second end adjustably securable relative to the second hinge member. An adjustment mechanism is included and is capable of disengaging the second end of the spring relative to the second hinge member and into engagement relative to the first hinge member to allow rotation of the second hinge member relative to the second end of the spring, and then re-engage the second end of the spring relative to the second hinge member, thereby changing engagement position of the second end of the spring relative to the second hinge member and adjusting the torsional spring tension.

14 Claims, 5 Drawing Sheets

U.S. PATENT DOCUMENTS

| | | | | | |
|---|---|---|---|---|---|
| 4,339,845 | A | | 7/1982 | Newlon et al. | |
| 4,419,788 | A | | 12/1983 | Prout | |
| 4,583,262 | A | | 4/1986 | Werner | |
| 4,709,445 | A | * | 12/1987 | Waldo et al. | 16/300 |
| 4,751,765 | A | | 6/1988 | Wu | |
| 4,756,051 | A | * | 7/1988 | Shy | 16/50 |
| 4,780,914 | A | | 11/1988 | Lin | |
| 4,817,242 | A | | 4/1989 | Rapp | |
| 4,829,628 | A | * | 5/1989 | Vuksic | 16/54 |
| 5,048,155 | A | | 9/1991 | Hwang | |
| 5,243,738 | A | | 9/1993 | Kiefer | |
| 5,333,355 | A | | 8/1994 | Beswick et al. | |
| 5,584,100 | A | | 12/1996 | Doyle et al. | |
| 5,715,574 | A | | 2/1998 | Schall | |
| 5,855,040 | A | * | 1/1999 | Lin | 16/50 |
| 6,256,839 | B1 | | 7/2001 | Wu | |
| 6,389,611 | B2 | | 5/2002 | Fujita | |
| 6,460,220 | B1 | | 10/2002 | Jackson | |
| 6,618,902 | B2 | * | 9/2003 | Wu | 16/298 |
| 6,732,408 | B2 | | 5/2004 | Wu | |

FOREIGN PATENT DOCUMENTS

| | | |
|---|---|---|
| AU | 63251/60 | 5/1963 |
| DE | 1961736 | 6/1971 |
| GB | 759211 | 10/1956 |
| GB | 1 382 227 | 1/1975 |

* cited by examiner

HINGE APPARATUS

BACKGROUND

Some doors and gates have spring loaded hinges for assisting with opening or closing the door or gate. A common design for such a hinge is to employ a torsion spring within the hinge to provide spring loading. Tension of the torsional spring in some designs is adjusted by rotating or twisting one end of the torsional spring with a tool, such as a screwdriver. Typically, the blade of the screwdriver is inserted into a screwdriver slot in a rotatable member that is fixed to the end of the torsional spring. The rotatable member is then secured in the desired rotational position by a locking arrangement, such as interlocking surfaces, pins, etc. A drawback of such a method of adjustment is that the user must have a tool on hand to perform the adjustment. In addition, adjustment can become difficult to perform when attempting to adjust a spring to a level that requires a lot of torque to twist the spring.

SUMMARY

The present invention includes a spring loaded hinge in which the tension can be easily adjusted without using tools, even when a relatively large torque is required to adjust the spring.

The hinge includes a first hinge member and a second hinge member that is rotatably coupled to the first hinge member. The hinge can have a torsion spring with a first end of the spring secured relative to the first hinge member and a second end adjustably securable relative to the second hinge member. An adjustment mechanism can be included that is capable of disengaging the second end of the spring relative to the second hinge member and into engagement relative to the first hinge member to allow rotation of the second hinge member relative to the second end of the spring, and then re-engage the second end of the spring relative to the second hinge member, thereby changing engagement position of the second end of the spring relative to the second hinge member and adjusting the torsional spring tension.

In particular embodiments, the adjustment mechanism can be hand operated and can include a push button that is secured to the second end of the torsion spring. The push button can have push button locking surfaces for engaging second hinge member locking surfaces for securing the second end of the spring relative to the second hinge member. Depression of the push button can axially compress the spring and disengage the push button locking surfaces from the second hinge member locking surfaces and into engagement with first hinge member locking surfaces to allow rotation of the second hinge member relative to the second end of the spring. Release of the push button can re-engage the push button locking surfaces with the second hinge member locking surfaces. The push button locking surfaces and the second hinge member locking surfaces can be engageable in a series of different rotational positions for providing different torsional spring tensions. The second hinge member can have a series of markings that are positioned to correspond to the series of different rotational positions for indicating a series of spring tension settings. An indicator can be included on the push button for pointing to a particular marking associated with a chosen spring tension setting. The first and second hinge members can include alignment indicators for alignment with each other so that the hinge members can be moved in a position which allows depression of the push button.

The first hinge member can include an elongate bore for housing the spring. The second hinge member can include first and second spaced arms that are rotatably coupled to the elongate bore with inward surfaces of the arms rotatably contacting opposite ends of the bore. The first arm of the second hinge member can have an aperture through which a distal portion of the push button extends. The second hinge member locking surfaces can surround the aperture on the inward surface of the first arm. The push button locking surfaces can include a series of spaced radial protrusions for engaging with the first and second hinge member locking surfaces. The first hinge member locking surfaces can include a series of elongate longitudinal protrusions extending within the elongate bore of the first hinge member and spaced apart from each other. A spring securing member can be secured to the first end of the spring and secured to the first hinge member for securing the first end of the spring relative to the first hinge member. The spring securing member can have a distal portion for rotatably engaging an aperture in the second arm of the second hinge member. A removable cap can be included for snapping into place on the first arm of the second hinge member for covering the push button. The first and second hinge members can each include mounting flanges, one mounting flange for mounting to a fixed support member, and the other mounting flange for mounting to a swinging member. Each mounting flange can have right angle mounting surfaces for contacting and securing to the respective member on two right angled surfaces. The first and second hinge members can be formed of plastic.

The present invention also includes a hinge system including a fixed support member and a swinging member. At least one hinge is included having a first hinge member and a second hinge member rotatably coupled to the first hinge member. The first and second hinge members each include mounting flanges. One mounting flange is secured to the fixed support member and the other mounting flange is secured to the swinging member. The hinge can have a torsion spring with a first end of the spring secured relative to the first hinge member and a second end adjustably securable relative to the second hinge member. An adjustment mechanism can be included that is capable of disengaging the second end of the spring relative to the second hinge member and into engagement relative to the first hinge member to allow rotation of the second hinge member relative to the second end of the spring, and then re-engage the second end of the spring relative to the second hinge member, thereby changing engagement position of the second end of the spring relative to the second hinge member and adjusting the torsional spring tension.

The present invention additionally provides a method of adjusting a hinge where the hinge includes a first hinge member and a second hinge member rotatably coupled to the first hinge member. The hinge can have a torsion spring with a first end of the spring secured relative to the first hinge member and a second end adjustably securable relative to the second hinge member. With an adjustment mechanism, the second end of the spring can be disengaged relative to the second hinge member and put into engagement relative to the first hinge member. The second hinge member is rotated relative to the first hinge member and the second end of the spring. The second end of the spring is re-engaged relative to the second hinge member, thereby changing engagement position of the second end of the spring relative to the second hinge member and adjusting the torsional spring tension.

In particular embodiments, the adjustment mechanism can be hand operated and can include a push button that is secured to the second end of the torsion spring. The push button can have push button locking surfaces for engaging second hinge member locking surfaces for securing the second end of the spring relative to the second hinge member. The push button can be depressed to axially compress the spring and disengage the push button locking surfaces from the second hinge member locking surfaces and into engagement with first hinge member locking surfaces to allow rotation of the second hinge member relative to the second end of the spring. The push button can be released to re-engage the push button locking surfaces with the second hinge member locking surfaces. The push button locking surfaces and the second hinge member locking surfaces can be re-engaged in one of a series of different possible rotational positions for providing a different torsional spring tension. The second hinge member can have a series of markings positioned to correspond to the series of different rotational positions for indicating a series of spring tension settings. The push button can have an indicator for pointing to a particular marking associated with a chosen spring tension setting. The chosen spring tension setting can be selected by rotating the second hinge member relative to the first hinge member and the second end of the spring until the push button indicator points to the desired marking. Alignment indicators on the first and second hinge members can be aligned with each other so that the hinge members can be moved in a position which allows depression of the push button. The first and second hinge members can each include mounting flanges, one mounting flange for mounting to a fixed support member and the other mounting flange for mounting to a swinging member. The swinging member can be rotated for rotating the second hinge member relative to the first hinge member and the second end of the spring. Typically, the swinging member is a gate or door with a large leverage or moment arm relative to the hinge axis so that the torque required for adjusting the spring is easily obtained by rotation of the swinging member.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
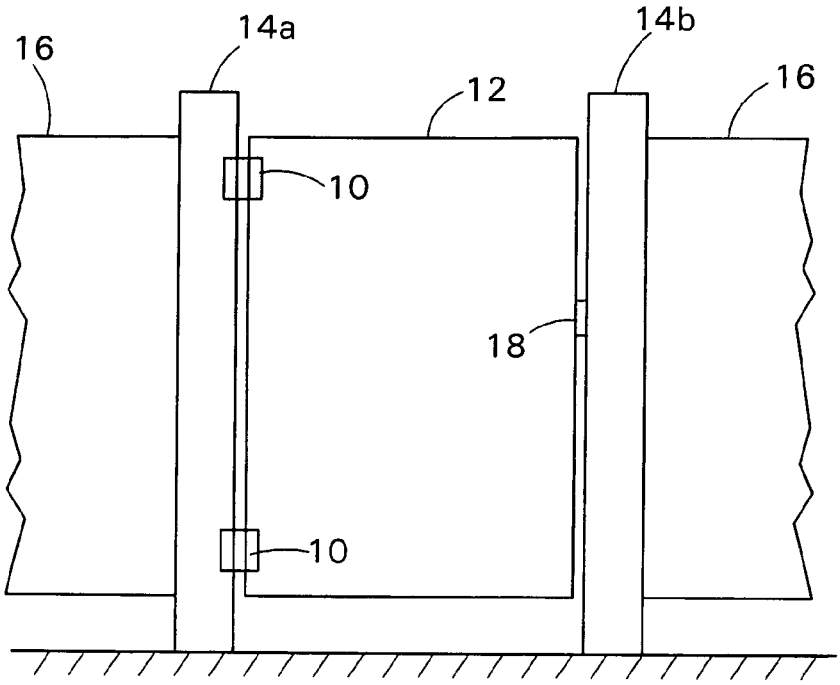
FIG. 1 is a schematic front view of a gate mounted to a fence post with hinges in accordance with the present invention.

Referring to FIG. 1, a swinging member such as a door or gate 12 can be mounted to a fixed support member or post 14*a* by one or more hinges 10 in the present invention. In the embodiment depicted in FIG. 1, hinges 10 mount to the gate 12 between the posts 14*a* and 14*b* of a fence 16, where the gate 12 can be latched to post 14*b* with a latch 18. It is understood that hinges 10 can be used in suitable exterior and interior applications which include a swinging member such as gates, doors, lids, etc. Embodiments of hinges 10 can be spring loaded, such as with a torsion spring 56 (FIG. 5), to assist with the opening or closing of the swing member 12. The tension of the spring 56 can be adjusted with a hand operated mechanism to suit the situation at hand.

Figure 3:
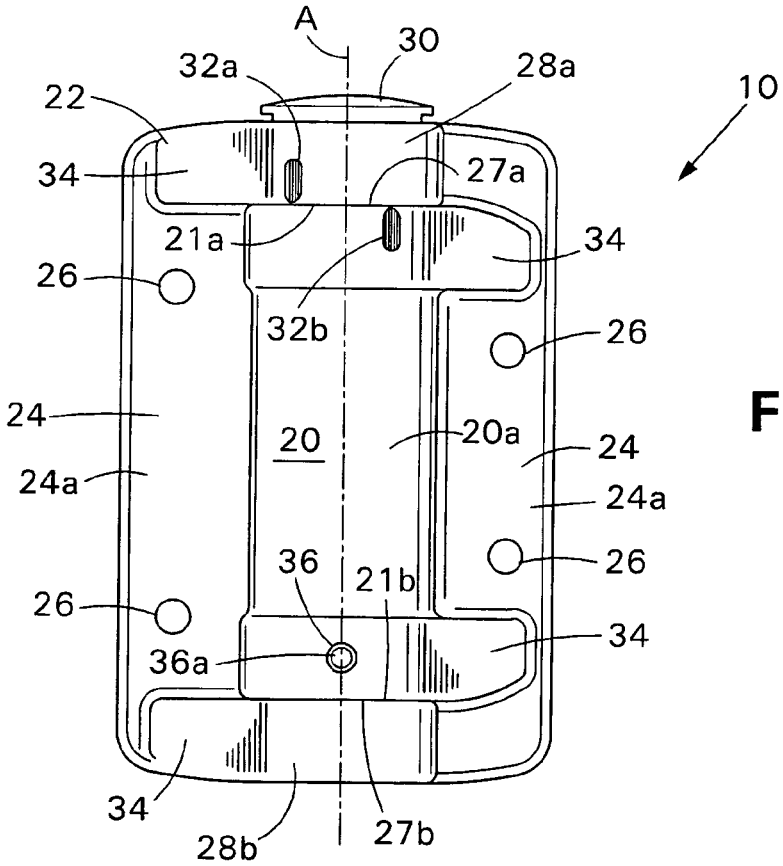
FIG. 3 is a front view of the hinge of FIG. 2.
Figure 2:
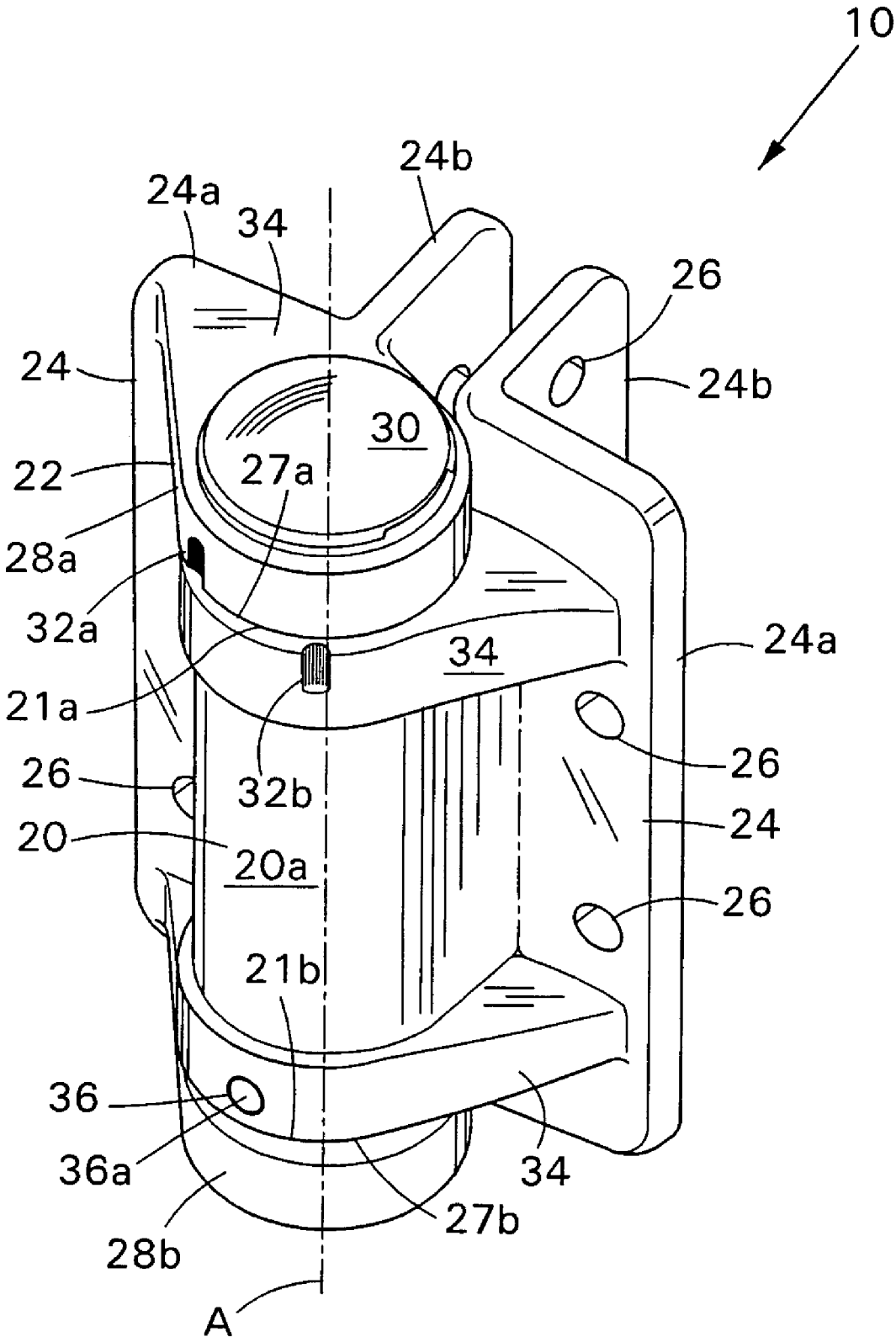
FIG. 2 is a perspective view of an embodiment of the hinge in the present invention.
Figure 4:
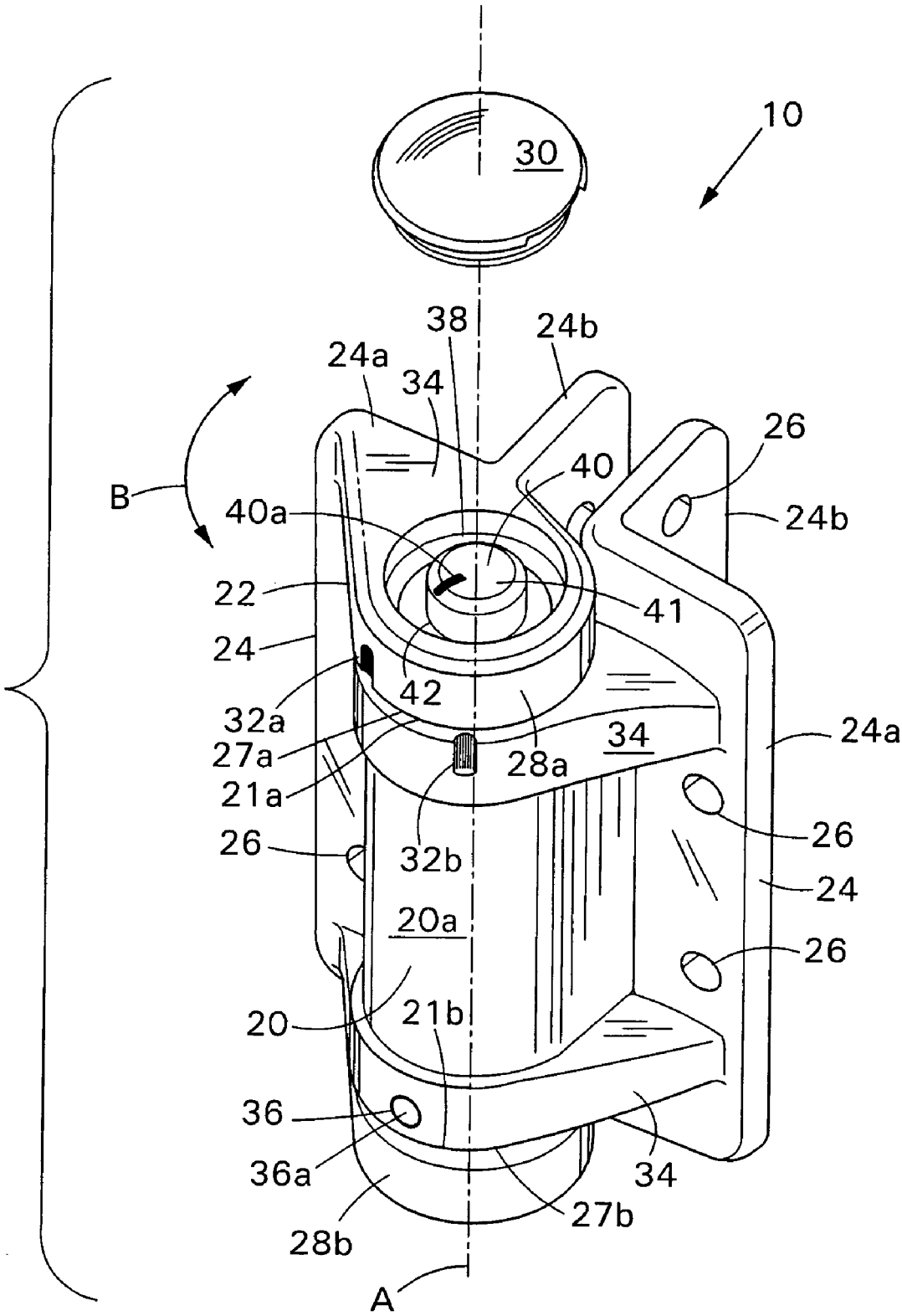
FIG. 4 is a perspective view of the hinge of FIG. 2 with the cap removed.

An embodiment of the hinge 10 is now described in detail. Referring to FIGS. 2 and 3, hinge 10 can have a first or inner hinge member 20 and a second or outer hinge member 22 which are rotatably coupled together about a hinge axis A. The first hinge member 20 can have a generally cylindrical elongate bore portion 20*a* which is connected to a first mounting flange 24. Reinforced portions or webs 34 can provide additional strength and rigidity between the bore portion 20*a* and the mounting flange 24. The reinforced portions 34 can be located at opposite ends of the bore portion 20*a*.

The second hinge member 22 has first and second hinge arms 28*a* and 28*b* which are connected to a second mounting flange 24. The arms 28*a* and 28*b* of the second hinge member 22 are spaced apart from each other and are rotatably coupled to the bore portion 20*a* of the first hinge member 20 with respective inward surfaces 27*a* and 27*b* rotatably contacting respective opposite ends 21*a* and 21*b* of the bore portion 20*a*. Reinforced portions or webs 34 can provide additional strength and rigidity between the arms 28*a* and 28*b* and the second mounting flange 24. The mounting flanges 24 on the first 20 and second 22 hinge members allow the securement of the hinge members 20 and 22 to the fixed support member or post 14*a* and the swinging member 12. Each mounting flange 24 can have two flange ears 24*a* and 24*b* which are at right angles to each other for mounting to the desired members 14*a* and 12 on two right angled surfaces. Mounting holes 26 in the flange ears 24*a* and 24*b* allow the use of fasteners, such as screws, bolts, etc. In other embodiments, the mounting flanges can have a single mounting surface.

Referring to FIGS. 4–7, the hinge 10 can include a torsion spring member 56 (FIG. 5) for spring loading hinge 10. The spring 56 can be adjusted to vary the rotational spring force generated by spring 56 and the rotational direction of the spring force for assisting with the opening or closing of the swinging member 12. The spring 56 can be housed within the interior 54 of the bore portion 20*a* of the first hinge member 20. A first end 56*a* of the spring 56 is secured relative to the first hinge member 20 and a second end 56*b* is adjustably securable relative to the second hinge member 22, for example, at the first arm 28*a*.

The first end 56*a* of the spring 56 can be secured to a spring securing member or anchor 58 (FIG. 5) which, in turn, is secured to the first hinge member 20 to secure the first end 56*a* of the spring 56 relative to the first hinge member 20. The first end 56*a* of the spring 56 can be secured to the securing member 58 by positioning the inner diameter 55 of the spring 56 over a cylindrical tip 70 of the securing member 58 against shoulder 72 and inserting a longitudinally extending spring tip 59 into a hole 74 in the shoulder 72 adjacent to the cylindrical tip 70. This prevents rotation of the first end 56*a* of the spring 56 relative to the securing member 58 about hinge axis A. The securing member 58 can be in turn secured in the bore portion 20*a* of first hinge member 20 by a pin 36*a* which is inserted in the first hinge member 20 through holes 36, and in the securing member 58 through hole 78. The securing member 58 can also be shaped to engage first hinge member locking surfaces 51 within the bore portion 20*a* to provide further rotational locking of the securing member 58. In the embodiment shown in FIG. 5, the first hinge member locking surfaces 51 can be three equally spaced inwardly directed longitudinal protrusions 52 which extend along the inner wall in the interior 54 of the bore portion 20*a* and are engaged by three suitably shaped recesses 76 in the securing member 58. The length of recesses 76 can be chosen so that the securing member 58 extends within the interior 54 of bore portion 20*a* only a given amount with the end of the recesses 76 acting as a stop. The portion of securing member 58 extending below the bore portion 20*a* can extend through and engage an aperture such as an opening or hole 50 within the second arm 28*b* of the second hinge member 22 for rotatably coupling arm 28*b* with the bore portion 20*a* along the hinge axis A. The securing member 58 can have a socket 80 on the outwardly facing end for insertion of a tool during assembly or maintenance. A drain channel or groove 77 can be formed on the outer lateral face of the securing member 58 for allowing any moisture or water within the bore portion 20*a* to drain out of the hinge 10. The outer lateral face of the securing member 58 is typically shaped to generally correspond to the general shape of the interior 54 of the bore portion 20*a*, and can be generally cylindrical.

The second end 56*b* of the spring 56 can be adjustably securable relative to the first arm 28*a* of the second hinge member 22 for adjusting the spring tension and rotational direction of the spring force generated by the spring 56. The second end 56*b* of the spring 56 can be secured to a hand operated push button member 40 which in turn is adjustably securable to the first arm 28*a* of the second hinge member 22 for adjustably securing the second end 56*b* of the spring 56 relative to the second hinge member 22. The second end 56*b* can be secured to the push button member 40 by positioning the inner diameter 55 of the spring over a cylindrical tip 60 of the push button member 40 against shoulder 66 and inserting a longitudinally extending spring tip 57 into a hole 64 in the shoulder 66 that is adjacent to the cylindrical tip 60. This prevents rotation of the second end 56*b* of the spring 56 relative to the push button member 40. The button 41 of push button member 40 can be generally cylindrical in shape to extend through and engage an aperture such as an opening or hole 42 within the first arm 28*a* of the second hinge member 22 for rotatably coupling the second arm 28*a* to the bore portion 20*a* of the first hinge member 20 about the hinge axis A.

Figure 5:
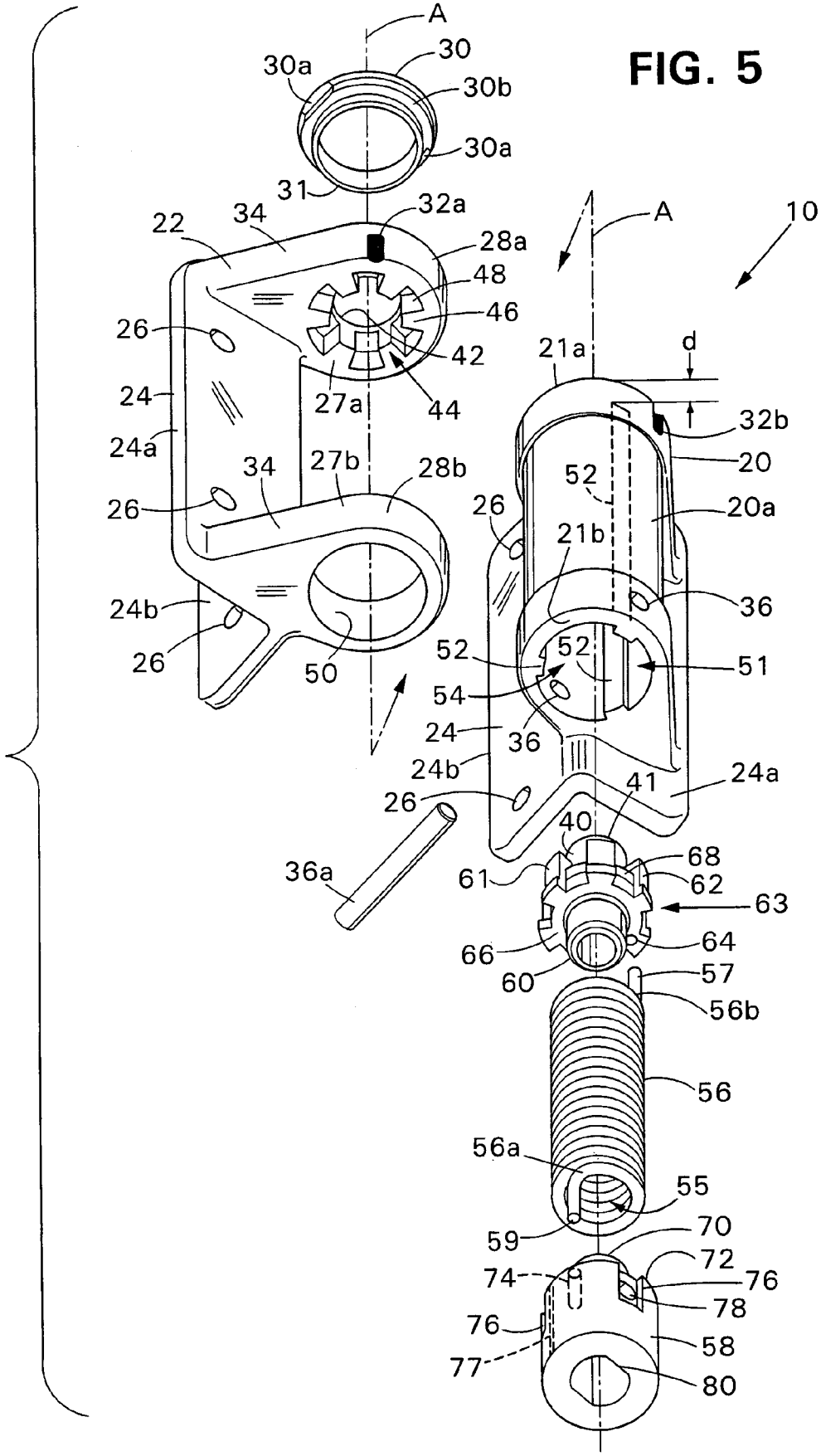
FIG. 5 is an exploded view of the hinge of FIG. 2.
Figure 7:
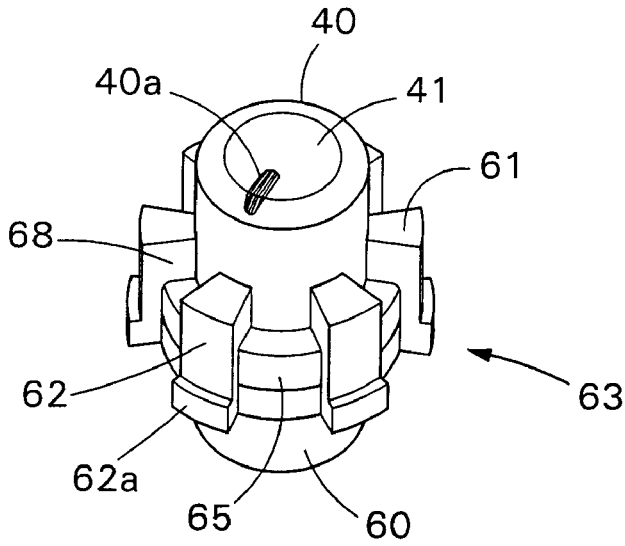
FIG. 7 is a top perspective view of the push button member.

The push button member 40 includes push button locking surfaces 63, which can include a series of spaced radial protrusions 62 that are separated from each other by a series of recesses 68 (FIGS. 5 and 7). In the embodiment shown, there can be six protrusions 62 and six recesses 68. Referring to FIG. 7, the protrusions 62 can be elongate with a generally trapezoidal cross section and extend from a diameter portion 65 over part of the diameter of the button 41. The button 41 has a diameter that is smaller than the diameter of portion 65. As a result, protrusions 62 can have end portions 61 which are engageable with second hinge member locking surfaces 44 in the first arm that surround the opening 42 (FIG. 5). The second hinge member locking surfaces 44 can include a series of recesses 48 having a generally trapezoidal cross section for mating with the end portions 61 of the protrusions 62 which have a corresponding generally trapezoidal cross section. The recesses 48 can be separated from each other by a series of protrusions 46 which mate with the recesses 68 of the push button member 40. In one embodiment, there can be six recesses 48 and six protrusions 46. The protrusions 62 can have raised radial portions 62*a* (FIG. 7) for more closely engaging the opening 54 of the bore portion 20*a* of the first hinge member 20.

When the push button locking surfaces 63 of push button member 40 are in engagement with the first arm 28*a* of the second hinge member 22, the button 41 extends through hole 42 in the first arm 28*a* of the second hinge member 22 into recess 38, the end portions 61 of the protrusions 62 extend into the recesses 48 surrounding the hole 42, and the cylindrical portion 60 and diameter portion 65 are typically contained within the bore portion 20*a* of the first hinge member 20. The protrusions 52 of the first hinge locking surfaces 51 are positioned a distance "d" away from the end 21*a* of the bore portion 20*a* which provides clearance from the push button locking surfaces 63 so that the push button member 40 can rotate within the bore portion 20*a* when the push button locking surfaces 63 are in engagement with the second hinge member locking surfaces 44. This allows the spring loaded first 20 and second 22 hinge members to rotate relative to each other during normal use.

Figure 6:
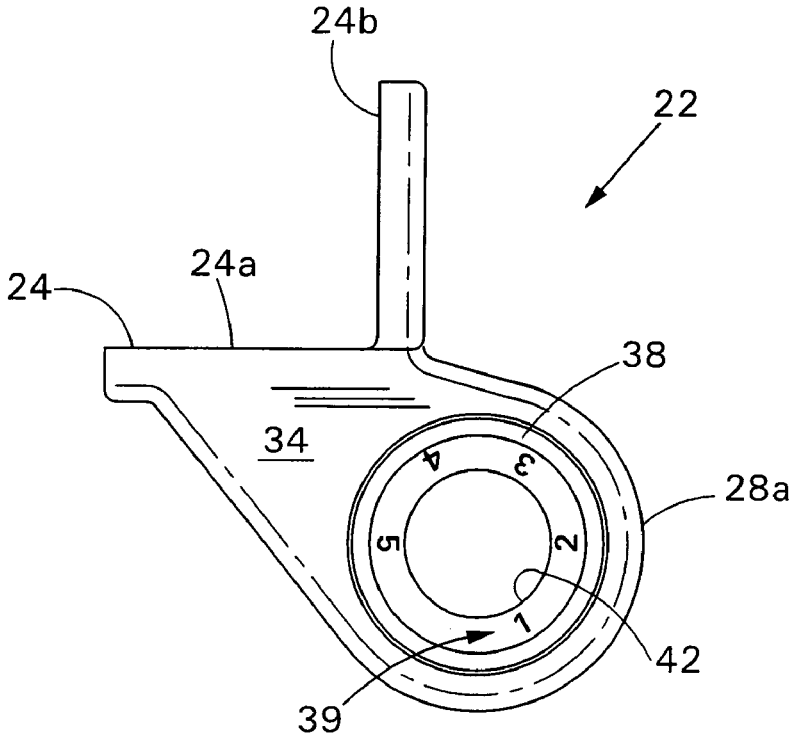
FIG. 6 is a top view of the second hinge member of the hinge of FIG. 2.

Referring to FIG. 6, the second hinge member 22 has a series of markings 39 within the recess 38 of the first arm 28*a* surrounding hole 42 which are positioned to correspond to particular rotational positions of the recesses 48 and protrusions 46 of the second hinge member locking surfaces 44 for indicating a series of spring tension settings. In the embodiment shown, the markings 39, for example, can be numbers 1–5 with a gap between the 1 and 5 to indicate a zero setting, thereby forming a total of six tension settings. The markings 39 can be at the bottom of recess 38 as shown, or other suitable locations, such as the top of the first arm 28*a*. The button 41 can have an indicator 40*a* for pointing to the particular marking associated with a chosen spring tension setting. The button 41 can be protected or hidden from view by a cap 30. The cap 30 can have a flange 31 which is snapped into the recess 38 until shoulder 30*b* engages the top of the first arm 28*a*. The shoulder 30*b* of cap 30 can have notches or recesses 30*a* to allow the cap to be easily pried off the first arm 28*a*.

In the embodiment shown, in order to adjust the spring tension of spring 56 after hinge 10 has been installed, for example, as shown in FIG. 1, first the cap 30 (FIG. 4) is pried off the first arm 28*a* of the second hinge member 22 with a screw driver, fingernail, etc. The swinging member, such as a gate or door 12, is then rotated for rotating the first 20 and second 22 hinge members relative to each other for aligning alignment indicators 32*b* and 32*a* on respective first and second hinge members (FIG. 3). The torsional spring tension of spring 56 may be increased or decreased in the alignment process. The leverage provided by the swinging member 12 allows this to be easily performed. The alignment of indicators 32*b* and 32*a* aligns the first 20 and second 22 hinge members so that the recesses 68 of push button locking surfaces 63 are aligned with the protrusions 52 of the first hinge member locking surfaces 51. In this position, the user can press the button 41 downwardly with his/her thumb or finger which axially compresses the spring 56 and disengages the push button locking surfaces 63 from the second hinge member locking surfaces 44. The top of the button 41 still engages the hole 42 for rotatably coupling the first arm 28*a* of the second hinge member 22 to the bore portion 20*a* of the first hinge member 20 about hinge axis A. As the push button member 40 is depressed, the push button locking surfaces 63 simultaneously disengage from the second hinge member locking surfaces 44 and engage the first hinge member locking surfaces 51 where the recesses 68 of the push button locking surfaces 63 capture the protrusions 52 of the first hinge member locking surfaces 51. Engagement of the push button locking surfaces 63 with the first hinge member locking surfaces 51 prevents spring 56 from unwinding so that the torsional tension of spring 56 obtained at the alignment position of indicators 32*b* and 32*a* is maintained.

While maintaining the push button member 40 in the depressed position so that the push button locking surfaces 63 are disengaged from the second hinge member locking surfaces 44 but in engagement with the first hinge member locking surfaces 51, the second hinge member 22 is able to rotate freely in a non-spring-loaded manner relative to the first hinge member 20, the push button member 40, and the second end 56*b* of the spring 56. The swinging member 12 is rotated until the indicator 40*a* on the button 41 is aligned with the desired spring tension setting marking on the first arm 28*a* of the second hinge member 22. The button 41 is then released, disengaging the push button locking surfaces 63 from the first hinge member locking surfaces 51 and into re-engagement with the second hinge member locking surfaces 44 in a new position resulting in a different torsional spring tension setting. The markings 39 are aligned with the second hinge member locking surfaces 44 to allow re-engagement of the push button locking surfaces 63 when the indicator 41 is aligned with the desired marking. In the embodiment shown, the indicator 40*a* on the button 41 can be in six different rotational positions, but it is understood that, depending upon the situation at hand, the locking surfaces 44, 51 and 63 can be configured to provide more or fewer discrete settings. Once the desired torsional spring tension setting is obtained, the cap 30 can be snapped back over recess 38. In applications where multiple hinges are employed, the process can be repeated for adjusting the tension on the other hinges 10. In some situations, it might be desirable to have multiple hinges 10 biased in opposite directions. In addition, hinges 10 can be presets before installation, where the user rotates the first 20 and second 22 hinge members relative to each other without the leverage benefit of a swinging memeber 12.

In one embodiment, the first hinge member 20, the second hinge member 22, and cap 30, the push button member 40, the spring securing member 58 and the pin 36*a* can be formed of high strength plastic, such as by injection molding or machining. Alternatively, one or more of these components can be made of other suitable materials such as metal. In outdoor applications, corrosion resistant materials are preferred such as plastic, stainless steel, metals or other materials with corrosion inhibitors, etc. The spring 56 can be a helical torsion spring. However, in other embodiments, spring 56 can be of other suitable configurations such as those including torsion bars.

While this invention has been particularly shown and described with references to preferred embodiments thereof, it will be understood by those skilled in the art that various changes in form and details may be made therein without departing from the scope of the invention encompassed by the appended claims.

For example, although the locking surfaces 44, 51, and 63 have been shown to have protrusions and recesses of particular shapes and configurations, different shapes and configurations can be used depending upon the situation at hand. For example, the protrusions can be short segments or bumps, or can be pins inserted into the various members at the appropriate locations. Also, one or more flats can be employed on various mating surfaces. In addition, although the interior 54 of bore portion 20*a* and the openings through arms 28*a* and 28*b* are described in one embodiment to be generally circular or cylindrical, in other embodiments, other suitable shapes can be employed, with the push button member 40, spring 56, and securing member 58 being shaped accordingly. In other embodiments, bore portion 20*a* can be replaced with two spaced arms which engage arms 28*a* and 28*b*. In such a case, the second hinge member 22 can include a third arm therebetween.

What is claimed is:

1. A hinge comprising:

a first hinge member;

a second hinge member rotatably coupled to the first hinge member;

a torsion spring having a first end secured relative to the first hinge member and a second end adjustably securable relative to the second hinge member; and an adjustment mechanism capable of disengaging the second end of the spring relative to the second hinge member and into engagement relative to the first hinge member to allow rotation of the second hinge member relative to the second end of the spring and then re-engage the second end of the spring relative to the second hinge member, thereby changing engagement position of the second end of the spring relative to the second hinge member and adjusting torsional spring tension, the adjustment mechanism being hand operated and comprising a push button that is secured to the second end of the torsion spring, the push button having push button locking surfaces and the second hinge member having second hinge member locking surfaces, the push button locking surfaces engage the second hinge member locking surfaces for securing the second end of the spring relative to the second hinge member, and the first hinge member having first hinge member locking surfaces that also engage the push button locking surfaces, whereby depression of the push button axially compresses the spring and disengages the push button locking surfaces from the second hinge member locking surfaces and into rotationally locked engagement with the first hinge member locking surfaces to allow rotation of the second hinge member relative to the second end of the spring, and release of the push button re-engages the push button locking surfaces with the second hinge member locking surfaces.

2. The hinge of claim 1 in which the first and second hinge members each include mounting flanges, one mounting flange for mounting to a fixed support member and the other mounting flange for mounting to a swinging member, each mounting flange having right angled mounting surfaces for contacting and securing to the respective member on two right angled surfaces.

3. The hinge of claim 1 in which the first and second hinge members are formed of plastic.

4. The hinge of claim 1 in which the push button locking surfaces and the second hinge member locking surfaces are engageable in a series of different rotational positions for providing different torsional spring tensions.

5. The hinge of claim 4 further comprising a series of markings on the second hinge member that are positioned to correspond to the series of different rotational positions for indicating a series of spring tension settings, and an indicator on the push button for pointing to a particular marking associated with a chosen spring tension setting.

6. The hinge of claim 5 further comprising alignment indicators on the first and second hinge members for alignment with each other so that the hinge members are in a position which allows depression of the push button.

7. The hinge of claim 4 in which the first hinge member includes an elongate bore for housing the spring, and the second hinge member includes first and second spaced arms that are rotatably coupled to the elongate bore with inward surfaces of the arms rotatably contacting opposite ends of the bore.

8. The hinge of claim 7 in which the first arm of the second hinge member has an aperture through which a distal portion of the push button extends, the second hinge member locking surfaces surrounding the aperture on the inward surface of the first arm.

9. The hinge of claim 8 in which the push button locking surfaces include a series of spaced radial protrusions for engaging with the first and second hinge member locking surfaces.

10. The hinge of claim 9 in which the first hinge member locking surfaces include a series of elongate longitudinal protrusions extending within the elongate bore of the first hinge member and spaced apart from each other.

11. The hinge of claim 10 further comprising a spring securing member secured to the first end of the spring and secured to the first hinge member for securing the first end of the spring relative to the first hinge member, the spring securing member having a distal portion for rotatably engaging an aperture in the second arm of the second hinge member.

12. The hinge of claim 8 further comprising a removable cap for snapping into place on the first arm of the second hinge member for covering the push button.

13. A hinge comprising:

a first hinge member having an elongate bore;

a second hinge member rotatably coupled to the first hinge member, the second hinge member including first and second spaced arms that are rotatably coupled to the elongate bore with inward surfaces rotatabty contacting opposite ends of the bore;

a torsion spring housed within the elongate bore having a first end secured relative to the first hinge member and a second end adjustably securable relative to the second hinge member;

a spring securing member secured to the first end of the spring and secured to the first hinge member for securing the first end of the spring relative to the first hinge member; and a hand operated adjustment mechanism capable of disengaging the second end of the spring relative to the second hinge member and into engagement relative, to the first hinge member to allow rotation of the second hinge member relative to the second end of the spring and then re-engage the second end of the spring relative to the second hinge member, thereby changing engagement position of the second end of the spring relative to the second hinge member and adjusting torsional spring tension, the hand operated adjustment mechanism comprising a push button that is secured to the second end of the torsion spring, the push button having push button locking surfaces and the second hinge member having second hinge member locking surfaces, the push button locking surfaces engage the second hinge member locking surfaces for securing the second end of the spring relative to the second hinge member, and the first hinge member having first hinge member locking surfaces that also engage the push button locking surfaces, whereby depression of the push button axially compresses the spring and disengages the push button locking surfaces from the second hinge member locking surfaces and into rotationally locked engagement with the first hinge member locking surfaces to allow rotation of the second hinge member relative to the second end of the spring, and release of the push button re-engages the push button locking surfaces with the second hinge member locking surfaces.

14. A hinge system comprising:

a fixed support member;

a swinging member;

at least one hinge comprising:

a first hinge member;

a second hinge member rotatably coupled to the first hinge member, the first and second hinge members each including mounting flanges, one mourning flange secured to the fixed support member and the other mounting flange secured to the swinging member;

a torsion spring having a first end secured relative to the first hinge member and a second end adjustably securable relative to the second hinge member; and an adjustment mechanism capable of disengaging the second end of the spring relative to the second hinge member and into engagement relative to the first hinge member to allow rotation of the second hinge member relative to the second end of the spring and then re-engage the second end of the spring relative to the second hinge member, thereby changing engagement position of the second end of the spring relative to the second hinge member and adjusting torsional spring tension, the adjustment mechanism being hand operated and comprising a push button that is secured to the second end of the torsion spring, the push button having push button locking surfaces and the second hinge member having second hinge member locking surfaces, the push button locking surfaces engage the second hinge member locking surfaces for securing the second end of the spring relative to the second hinge member the first hinge member having first hinge member locking surfaces that also engage the push button locking surfaces, whereby depression of the push button axially compresses the spring and disengages the push button locking surfaces from the second hinge member locking surfaces and into rotationally locked engagement with the first hinge member locking surfaces to allow rotation of the second hinge member relative to the second end of the spring, and release of the push button re-engages the push button locking surfaces with the second hinge member locking surfaces.

* * * * *

UNITED STATES PATENT AND TRADEMARK OFFICE

CERTIFICATE OF CORRECTION

PATENT NO. : 7,210,199 B2
APPLICATION NO. : 11/020020
DATED : May 1, 2007
INVENTOR(S) : Richard T. Clark It is certified that error appears in the above-identified patent and that said Letters Patent is hereby corrected as shown below:

Claim 13, column 9, line 53, after “relative” delete “,”

Claim 14, column 10, line 25, remove “mourning” and insert

--mounting --

Claim 14, column 10, line 48, after “second hinge member” insert

--,--

Signed and Sealed this

Third Day of July, 2007

JON W. DUDAS
*Director of the United States Patent and Trademark Office*

UNITED STATES PATENT AND TRADEMARK OFFICE
Certificate

Patent No. 7,210,199 B2 Patented: May 1, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Richard T. Clark, Clinton, MA (US); Patrick M. Harris, Downers Grove, IL (US)

Signed and Sealed this Fifth Day of April 2011.

Victor Batson
*Supervisory Patent Examiner*
Art Unit 3677
Technology Center 3600